United States Patent [19]

Kishino et al.

[11] 4,223,244

[45] Sep. 16, 1980

[54] FLUORESCENT DISPLAY DEVICE WITH POSITION SELECTING AND COLUMN/ROW SELECTING GRIDS

[75] Inventors: Takao Kishino; Kishio Kawasaki; Nobuo Yamaguchi, all of Mobara, Japan

[73] Assignee: Futaba Denshi Kogyo K.K., Chiba, Japan

[21] Appl. No.: 951,388

[22] Filed: Oct. 16, 1978

[30] Foreign Application Priority Data

Oct. 18, 1977 [JP] Japan ..... 52/124114
Sep. 7, 1978 [JP] Japan ..... 53/109111

[51] Int. Cl.[2] ..... H01J 1/46; H01J 1/90; H01J 63/06

[52] U.S. Cl. ..... 313/497; 313/268; 313/348

[58] Field of Search ..... 313/497, 348, 268, 257, 313/195, 495, 496, 519

[56] References Cited

U.S. PATENT DOCUMENTS

| | | | |
|---|---|---|---|
| 2,415,360 | 2/1947 | McIntosh | 313/268 X |
| 2,503,806 | 4/1950 | Diggle | 313/257 |
| 3,375,391 | 3/1968 | Day | 313/257 X |
| 3,435,274 | 3/1969 | Miller | 313/348 |
| 3,571,655 | 3/1971 | Tanimoto | 313/497 X |
| 3,842,313 | 10/1974 | Van Daelen et al. | 313/519 X |

*Primary Examiner*—Palmer O. Demeo
*Attorney, Agent, or Firm*—Oblon, Fisher, Spivak, McClelland & Maier

[57] ABSTRACT

A fluorescent display device having pattern display sections each composed of phosphor-coated anodes arranged in the form of a matrix, at least a filament for emitting electrons when heated, the anodes being selectively bombarded with electrons emitted from the cathode to produce a visual display, position-selecting grids provided between the filament and the pattern display sections, column-selecting grids or row-selecting grids provided opposite to the columns or rows of the anodes, and a frame member provided, on its surface facing the filament, with the position-selecting grids and on its surface facing the pattern display section with the column-selecting grids or the row-selecting grids, the frame member being made of insulating material at least where necessary. With the provision of the frame member, the device of the present invention can be assembled easily, securely and correctly, and can produce a high-quality display.

7 Claims, 9 Drawing Figures

FLUORESCENT DISPLAY DEVICE WITH POSITION SELECTING AND COLUMN/ROW SELECTING GRIDS

BACKGROUND OF THE INVENTION

1. Field of the Invention

The present invention relates to a fluorescent display device and, more particularly, to a fluorescent display device of the matrix-display type for displaying numerals, characters, graphic forms, or the like.

2. Description of the Prior Art

Generally, the fluorescent display device for producing a visual display by bombarding the anodes coated with fluorescent material with thermions emitted from the heated filamentary cathode (hereinafter sometimes referred to as filament) has advantages in that it gives high-quality fluorescent colors, can be driven on a low voltage and is low in power consumption. Therefore, it is widely used as the display device for various electronic equipment and the like.

Heretofore, the fluorescent display device usually has a plurality of pattern display sections composed of, for instance, seven segment-shaped anodes arranged in the form of the numeral 8, and produces a visual display by the pattern display sections. Thus, it is mainly used for displaying numeric characters.

Meanwhile, with the diversification of the information to be processed by the electronic equipment and the like, it becomes necessary for the display device to display patterns in addition to numeric characters.

Accordingly, in order to display not only numeric characters but also characters and graphic forms, the fluorescent display device of the so-called matrix-display type has been developed and put into practical use, in which each pattern display section is composed of a plurality of phosphor-coated anodes in the shape of, for instance, dots arranged in the form of a matrix and in which the anodes of each pattern display section are selectively given an anode potential thereby to display characters, graphic forms, or the like.

In the case of the fluorescent display device of the matrix-display type, various modifications different in production process and drive system have been heretofore proposed. In this connection, the inventors of the present invention have already developed a fluorescent display device of the matrix-display type which can produce a visual display by the use of a reduced number of external terminals and therefore a reduced number of drive circuits.

In FIG. 1, reference numeral 1 designates a substrate made of insulating material, as glass or ceramics. On the substrate 1, there are provided wiring conductors 4, the number of which corresponds to the number of rows of phosphor-coated anodes 3 forming each of pattern display sections $2(2_1$ and $2_2)$. An insulating layer 5 is laminated on the substrate 1 on which the wiring conductors 4 have been provided. The insulating layer 5 has through-holes for the respective anodes 3 to be arranged in the form of matrixes. The through-holes in insulating layer 5 are provided so that the anodes on the same row may communicate with one of the wiring conductors 4. Also, the through-holes in insulating layer 5 are filled with conductive material. The anodes 3 are provided on the through-holes filled with the conductive material so that they are electrically connected to the wiring conductors 4 through the conductive material. Column-selecting grids $6(6_{11}-6_{1m}$, $6_{21}-6_{2m})$ are provided above and opposite to the respective columns of the anodes 3 of the pattern display sections 2. Although not shown in FIG. 1, the column-selecting grids 6 positioned above and opposite to the corresponding anode columns of the respective pattern display sections 2 are electrically connected together.

Position-selecting grids $7(7_1$ and $7_2)$ electrically independent of each other correspond to the respective pattern display sections 2, being provided above the column-selecting grids 6. Reference numeral 8 designates one or a plurality of filaments provided above the position-selecting grids 7 and adapted to emit thermions when heated.

In addition, a package (not shown) having at least a transparent display wall is bonded to the substrate 1 along, for instance, the periphery thereof so that the package may maintain the above-mentioned electrodes under a high vacuum. The external terminals of the electrodes are airtightly penetrated through the package.

The fluorescent display device shown in FIG. 1 may be operated as follows:

The position-selecting grids 7 provided for the respective pattern display sections 2 are successively given a positive potential with respect to the filament of filament 8 to successively select the pattern display sections 2.

While a particular pattern display section 2 is being selected by one of the position-selecting grids 7, the column-selecting grids 6 corresponding to the particular pattern display section 2 are successively given a positive potential thereby to scan the column-selecting grids 6. Simultaneously, in synchronization with the scanning of the column-selecting grids 6, the wiring conductors 4 to which the anodes 3 are connected are successively given a positive potential. As a result, thermions emitted from the filament or filaments 8 impinge on the anode 3 positioned at the point where the wiring conductor 4 given a positive potential crosses the column-selecting grid 6 given a positive potential. Thus, the layer of phosphor or fluorescent material coated on this anode 3 emits light.

In other words, when a particular postion-selecting grid 7 is being given a positive potential, the column-selecting grids 6 corresponding to the position-selecting grids 7 are scanned with the consequent result that the corresponding pattern display section 2 produces a visual display of characters, graphic forms, or the like. In this manner, the position-selecting grids 7 are scanned and thereby all the pattern display sections 2 produce a visual display of characters, graphic forms, or the like.

In this example, the number of external terminals required for giving positive potentials to the electrodes is equal to the sum of the number of the wiring conductors 4 provided according to the number of rows of the anodes 3 of each pattern display section 2, the number of the column-selecting grids 6 provided according to the number of columns of the anodes 3 of each pattern display section, the number of the position-selecting grids 7 provided according to the number of the pattern display sections 2, and the number of external terminals for the filaments 8. Therefore, the number of external terminals and that of the drive circuits can be reduced.

In this example, the wiring conductors 4 may be arranged in the arranging direction of the anodes 3.

Therefore, the wiring conductors 4 are very easy to form, and its production process is greatly simplified.

As mentioned above, the fluorescent display device shown in FIG. 1 has an advantage in that its wiring conductors 4 and anodes 3 are very easy to form. However, it has a disadvantage in that the operation for arranging the position-selecting grids 7 and the column-selecting grids 6 in place is very troublesome.

More particularly, the operation for correctly arranging the column-selecting grids 6 above and opposite to the respective columns of the anodes 3 and the operation for correctly arranging the position-selecting grids 7 above the column-selecting grids 6 are both very troublesome, since they must be electrically independent of one another and must be positioned close to one another. Accurate positioning is also very difficult.

Especially, when a small-sized display device is produced or when the anodes 3 are arranged at close intervals in order to produce a fine and delicate display, the difficulties of the above-mentioned arranging operations are further intensified. In addition, in the case of the multi-row-display type fluorescent display device in which a plurality of rows of the pattern display sections 2 are provided on a single substrate 1, it is very difficult to correctly position the column-selecting grids 6 and the position-selecting grids 7 with respect to the respective pattern display sections 2, to arrange the grids 6 or 7 at a uniform height with respect to the pattern display sections 2, and to keep them in the perfectly electrically-independent condition.

SUMMARY OF THE INVENTION

The present invention is intended to eliminate the above-mentioned disadvantages of the prior art.

Therefore, it is an object of the present invention to provide a fluorescent display device of the matrix-display type which can extremely simplify the operation for arranging the column-selecting grids and the position-selecting grids, which can at all times fixedly hold the above-mentioned grids at correct positions with respect to the respective pattern display sections while keeping them electrically perfectly insulated from one another, and which can produce a high-quality and clear display of characters, graphic forms, etc., without uneven brightness. In order to accomplish this object, the invention provides a frame member at least a part of which is made of insulating material and which has a thickness controlled by the distance from the position-selecting grids to the column-selecting grids and also is provided on its upper and bottom surfaces with the position-selecting grids and the column-selecting grids, respectively.

It is another object of the present invention to provide an inexpensive fluorescent display device of the matrix-display type and which can accurately control the distance from the column-selecting grids to the position-selecting grids, the spacing between the column-selecting grids and the spacing between the position-selecting grids and which can separate the operation for assemblying the above-mentioned grids from that for forming the pattern display sections and can make the above operation very easy. In order to accomplish this object, the invention provides the above-mentioned frame member provided on its upper and bottom surfaces with the position-selecting grids and the column-selecting grids, respectively.

It is still another object of the present invention to provide a fluorescent display device of the matrix-display type which can eliminate deformations such as creases and loosening liable to occur on the mesh-shaped grids due to expansion and contraction or mechanical stresses associated with thermal changes during the production process. In order to accomplish this object, the invention provides a frame member provided at its upper and bottom surfaces with the position selecting grids and the column-selecting grids respectively, this frame member being composed of a plurality of cross members of insulating material and a plurality of side members made of the same material as the position-selecting grids and the column-selecting grids or made of metallic material having almost the same thermal expansion properties as the above grids.

DETAILED DESCRIPTION OF THE PREFERRED EMBODIMENTS

Now, the preferred embodiments of the present invention will be hereinafter described with reference to the accompanying drawings.

Figure 2:
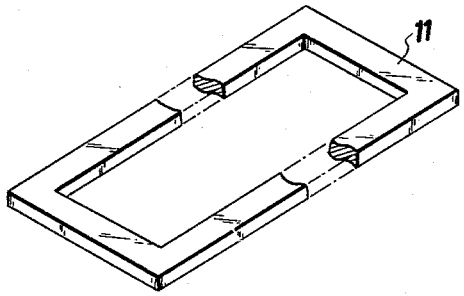
FIG. 2 is a schematical perspective view of a frame member for use in the fluorescent display device according to the first preferred embodiment of the present invention.
Figure 3:
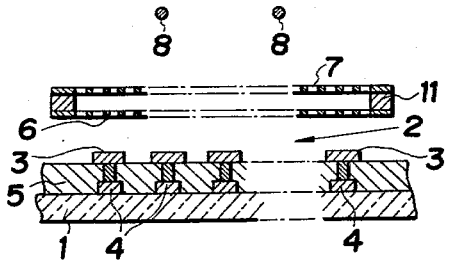
FIG. 3 is a transverse sectional view of the fluorescent display device according to the first preferred embodiments of the present invention.
Figure 4:
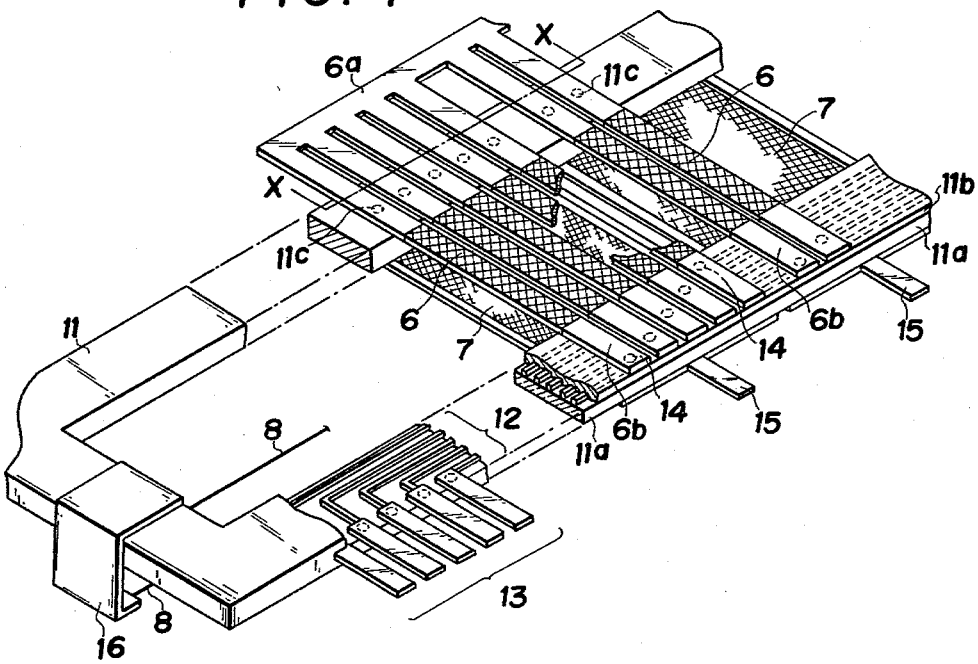
FIG. 4 is a partially cutaway detailed perspective view of the essential part of the fluorescent display device according to the first preferred embodiment of the present invention.

Reference is first made to FIGS. 2 to 4 which show the first embodiment of the present invention.

FIG. 2 shows a frame member 11 for use in the fluorescent display device according to the first embodiment of the present invention. The frame 11 is made of insulating material, such as mica or ceramics, being formed in the shape of a window-frame. The thickness of the frame 11 corresponds to the space between the plane where column-selecting grids 6 are arranged and that where position-selecting grids 7 are arranged, as shown in FIG. 3.

Figure 1:
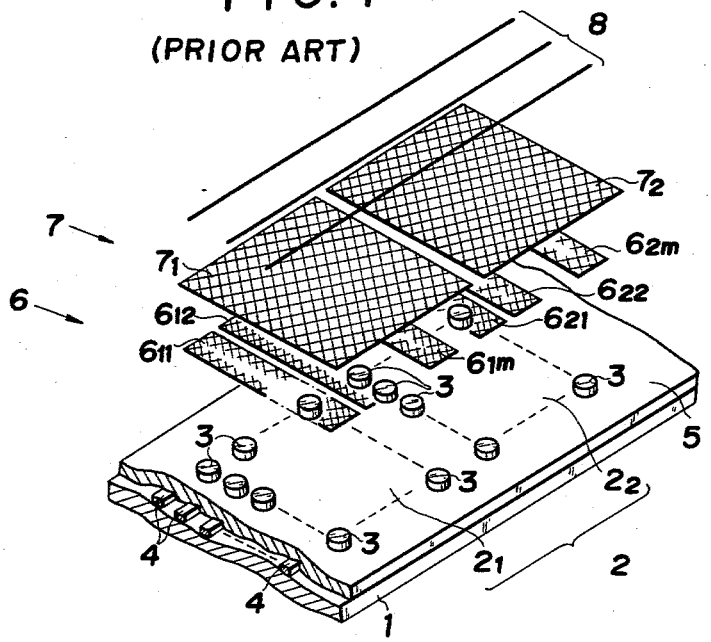
FIG. 1 (PRIOR ART)
FIG. 1 is an exploded perspective view of the essential part of a conventional fluorescent display device of the matrix-display type.

FIG. 3 is a transverse sectional view of the basic arrangement of the fluorescent display device according to the first embodiment of the present invention in which the column- and position-selecting grids 6 and 7 are incorporated by the use of the frame member 11. In FIGS. 1 and 3, like reference numerals designate corresponding parts.

In FIG. 3, reference numeral 2 designates pattern display sections having anodes 3 as in the case of the conventional fluorescent display device shown in FIG. 1. The column-selecting grids 6 are mounted on the bottom surface of the frame member 11 at predetermined intervals so that they face the respective columns of the anodes 3 arranged in the form of a matrix. The position-selecting grids 7 adapted to be kept at a positive potential so as to successively select the pattern display sections 2 are mounted on the upper surface of the frame member 11 at predetermined intervals so that they face the respective pattern display sections 2.

In this case, mounting of the column- and position-selecting grids 6 and 7 on the frame member 11 may be performed in the following manner:

For instance, metal paste suitable as solder is printed on the predetermined positions of the frame member 11, being then heated and baked to form junctions. Then, the metallic supporting sections of the column-selecting grids 6 or position-selecting grids 7 are placed on the above-mentioned junctions, being brazed by heating.

Thus, the column-selecting grids 6 are electrically insulated from the position-selecting grids 7 by the frame member 11 made of insulating material, being kept at a predetermined spaced apart distance. The assembly of the column-selecting grids 6 and position-selecting grids 7 thus made is fixedly disposed at a predetermined height above an insulating layer 5 (which corresponds to that of the conventional fluorescent device shown in FIG. 1) by suitable supports to place the grids 6 and 7 at desired positions.

As mentioned above, the distance from the column-selecting grids 6 to the position-selecting grids 7 can be controlled by the thickness of the frame member 11. Besides, intervals between the column-selecting grids 6 themselves and between the position-selecting grids 7 themselves can be correctly determined with great ease during assembly. Thus, according to the present invention, the operational efficiency and positioning accuracy during assembly can be greatly improved.

In addition, the frame member 11 produces its additional effect in the form of reinforcing the column- and position-selecting grids 6 and 7. As a result, the arranging operation of the grids 6 and 7 can be very much simplified, and the positioning thereof can be performed correctly.

For this reason, according to the present invention, the intervals between the pattern display sections 2, between the column-selecting grids 6 and between the position-selecting grids 7 can be made uniform. Consequently, uneven brightness or luminance can be prevented from occurring between the pattern display sections 2 or between the anodes 3. Thus, the fluorescent display device of the present invention can give a display very high in quality.

Now, a practical example of the assembly of the frame member 11, column-selecting grids 6 and position-selecting grids 7 will be hereinafter described with reference to FIG. 4.

FIG. 4 is a perspective view illustrating the assembly of the frame member 11, column-selecting grids 6 and position-selecting grids 7 as it appears when viewed from the side of the column-selecting grids 6. In this example, the frame member 11 is composed of two layers 11*a* and 11*b*, between which there are provided wiring conductors 12 for the column-selecting grids 6. In addition, the frame member 11 is provided with external terminals 13 for the column-selecting grids 6, external terminals 15 for the position-selecting grids 7, and holders 16 for a filament or filaments 8 (corresponding to that shown in FIG. 1). With the above construction, the above-mentioned assembly can be made in such a very simplified process as will be hereinafter described in detail.

The wiring conductors 12 for the column-selecting grids 6, the number of which corresponds to the number of columns per pattern display section 2 (5 columns, in the case of the example shown in FIG. 4), are provided on a frame member component 11*a* (which forms the frame member layer 11*a*). The wiring conductors 12 are connected, at the ends thereof, to the external terminals 13 for the column-selecting grids 6, respectively, as shown in FIG. 4. Then, a frame member component 11*b* (which forms the frame member layer 11*b*) provided at its predetermined positions with through-holes 14 communicating with the respective wiring conductors 12 is laminated on the frame member component or layer 11*a* on which the wiring conductors 12 are provided. In this manner, the frame member 11 is formed from the frame member components 11*a* and 11*b*. Besides, the through-holes 14 are filled with conductive material. Junctions 11*c* are formed at predetermined positions on the surface of the frame member component 11*b* by printing and baking metal paste suitable as solder, such as nickel, thereon.

In order to facilitate the production and mounting of the column-selecting grids 6, they are previously provided with a connecting section 6*a* made of metallic material, by which they are connected together as shown. The connecting section 6*a* of the column-selecting grids 6 is placed on the junctions 11*c*, being heated for brazing. Thus, the grids 6 are attached to the frame member 11. Each of the grids 6 has a supporting section 6*b* made of metallic material at its end as shown. The supporting sections 6*b* are connected to the conductive material filled in the through-holes 14 of the frame member component 11*b*. Thus, the corresponding column-selecting grids 6 for the respective pattern display sections 2 are electrically connected in common by the wiring conductors 12 which are connected to the respective external terminals 13. After the grids 6 are mounted, the connecting section 6*a* is removed along the dot-dash line X—X in FIG. 4, for instance.

The position-selecting grids 7, similar to the column-selecting grids 6, may be mounted as follows:

Junctions are formed on the mounting surface of the frame member 11 by printing and baking metal paste suitable as solder thereon. The supporting sections of the position-selecting grids 7 are placed on the above-mentioned junctions, being fixedly mounted on the frame member 11 by brazing. In this case, each of the position-selecting grids 7 is previously provided with an external terminal 15 formed integrally with the supporting section thereof.

In addition, filament holders 16 for supporting the filament or filaments 8 are attached to the longitudinal ends of the frame member 11, respectively.

Thus, the structure shown in FIG. 4 can be assembled by the use of the frame member 11 so that the correct positional relationships are established among the column-selecting grids 6, the wiring conductors 12 and external terminals 13 thereof, the position-selecting grids 7 and the external terminals 15 thereof, and the filament holders 16. In addition, the assembly of the structure can be performed separately from the operation for mounting the anodes 3 on the substrate 1. As a result, the assembly can be very much simplified and, in addition, can be performed with highly improved efficiency and with sufficiently high accuracy.

In the above-mentioned first preferred embodiment, description was made on an example of the single-row-display type fluorescent display device in which the pattern display sections 2 are arranged on a single sheet of the substrate 1 in a line in the direction of the row.

Figure 5:
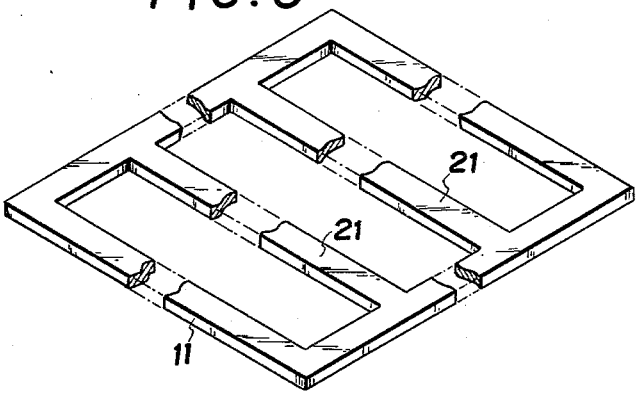
FIG. 5 is a schematical perspective view of a frame member for use in the fluorescent display device according to the second preferred embodiment of the present invention.

Meanwhile, in the so-called multi-row-display type fluorescent display device in which the pattern display sections 2 are arranged in a plurality of lines, the frame member 11 may be provided, as necessary, with reinforcing members 21 positioned opposite to the spaces between the rows of the pattern display sections 2 as shown in FIG. 5 associated with the second preferred embodiment of the present invention. Besides, in a large-sized display device, the frame member 11 may be reinforced by providing the reinforcing members positioned opposite to the spaces between the pattern display sections 2, even when the pattern display sections 2 are arranged in a single row.

In order to reinforce the assembly consisting of the frame member 11, the column-selecting grids 6 and the position-selecting grids 7, the reinforcing members may be attached to the frame member 11 on which the column-selecting grids 6 or the position-selecting grids 7 have been mounted. If, in this case, the reinforcing members are attached to the side of the frame member 11 where the column-selecting grids 6 have been mounted, they can serve as spacer members for controlling the distance from the pattern display sections 2 to the column-selecting grids 6. Thus, the operation for disposing the above-mentioned assembly above the pattern display sections 2 can be further simplified.

Now, the third preferred embodiment of the present invention will be hereinafter described with reference to FIGS. 6 to 8.

Figure 6:
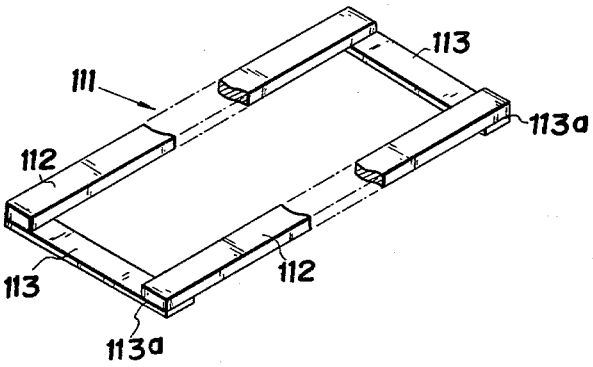
FIG. 6 is a schematical perspective view of a frame member for use in the fluorescent display device according to the third preferred embodiment of the present invention.

FIG. 6 is a schematical perspective view of a frame member 111 for use in the fluorescent display device according to the third preferred embodiment of the present invention. As shown in FIG. 6, the frame member 111 is formed in the shape of a window frame, consisting of cross members 112 and side members 113 which are joined together by brazing or the like. The cross members 112 are made of insulating material, such as mica or ceramics. The side members 113 are made of the same material as the column- and position-selecting grids to be mounted on the cross members 112 or of a metallic material having almost the same thermal expansion properties as these grids. Besides, the thickness of the cross members 112 corresponds to the vertical distance from the column-selecting grids 6 to the position-selecting grids 7 that have been arranged in place.

Figure 7:
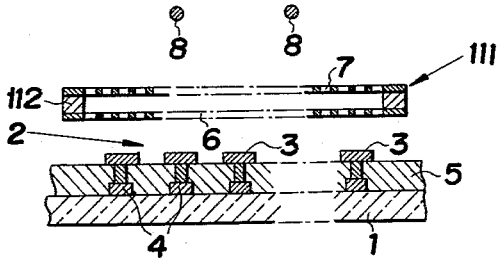
FIG. 7 is a transverse sectional view illustrating the basic arrangement of the fluorescent display device according to the third preferred embodiment of the present invention.

FIG. 7 is a transverse sectional view of the basic arrangement of the fluorescent display device according to the third embodiment of the present invention in which the column-selecting grids 6 and the position-selecting grids 7 are arranged by the use of the frame member 111 mentioned above. In FIGS. 1 and 7, like reference numerals designate corresponding parts.

In FIG. 7, the column-selecting grids 6 positioned opposite to the respective columns of the anodes 3 of the pattern display sections 2 are attached to the predetermined positions of the bottom surfaces of the cross members 112 of the frame member 111, respectively. The position-selecting grids 7, which are kept at a positive potential in order to successively select the pattern display sections 2, are mounted on the upper surface of the cross members 112.

When the frame member 111 is formed, fixing of the side members 113 on the cross members 112 and fixing of the column-selecting grids 6 and the position-selecting grids 7 on the cross members 112 may be performed as follows:

Junctions are previously formed at the predetermined positions on the cross members 112 by printing metal paste suitable as solder thereon and then by baking the metal paste. The junctions 113*a* of the side members 113 and the supporting sections of the grids 6 and 7 are placed on the corresponding junctions of the cross members 112, being heated for brazing. Thus, all these members and grids are formed into one piece. In this case, brazing the side members 113 and grids 6 and 7 to the cross members 112 may be performed either simultaneously in the same process or separately in the separate processes.

With the arrangement mentioned above, the column-selecting grids 6 are electrically insulated from and located at a predetermined distance from the position-selecting grids 7 by the provision of the cross members 112 made of insulating material. The assembly of the grids 6 and 7 thus constructed are fixedly disposed at a predetermined height above the insulating layer 5 by the use of suitable supports. Thus, the operation for arranging the grids 6 and 7 in place is completed.

As mentioned above, the distance from the column-selecting grids 6 to the position-selecting grids 7 are controlled by the thickness of the cross members 112 of the frame member 111. Besides, the spacing between the column-selecting grids 6 and that between the position-selecting grids 7 can be accurately determined in the course of the assemblying operation with great ease. Therefore, excellent operational efficiency and highly-accurate positioning can be expected.

Each of the column-selecting grids 6 and position-selecting grids 7 is in the form of a net of very fine meshes because of its functional requirements, and therefore is usually liable to deformations such as creases and loosening under the influence of mechanical external forces, thermal changes such as heating and cooling performed during the production process, etc. According to the present invention, however, the grids 6 and 7 are reinforced by the frame member 111 and, in addition, the side members 113 of the frame member 111 are made of either the same material as the grids 6 and 7 or a metallic material having almost the same thermal expansion properties as the grids 6 and 7. Therefore, the grids 6 and 7 are safely supported so that they are protected against the occurrence of deformations caused by thermal changes such as heating and cooling in the production process. Thus, in arranging the grids 6 and 7 above the pattern display sections 2, the arranging operations thereof can be very much simplified and, in addition, the positioning thereof can be accurately performed.

Accordingly, the spacing between each pattern display section 2 and the corresponding column-selecting grids 6 and that between each pattern display section 2 and the corresponding position-selecting grid 7 can be made uniform. As a result, uneven brightness or luminance occurring between the pattern display sections 2 or between the anodes 3 can be prevented, and therefore a display very high in quality can be obtained.

Now, a practical example of the assembly consisting of the frame member 111, column-selecting grids 6 and position-selecting grids 7 will be hereinafter described with reference to FIG. 8.

Figure 8:
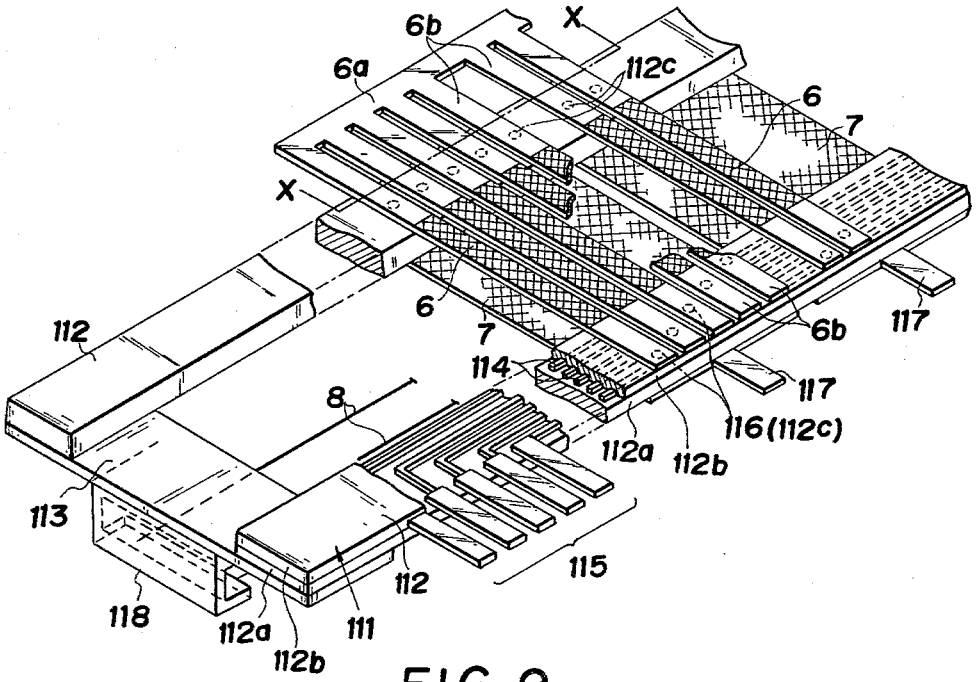
FIG. 8 is a partially cutaway detailed perspective view of the essential part of the fluorescent display device according to the third preferred embodiment of the present invention.

FIG. 8 is a perspective view illustrating the assembly composed of the frame member 111 consisting of the cross members 112 and side members 113, the column-selecting grids 6 and the position-selecting grids 7 as it appears when viewed from the side of the column-selecting grids 6. In this example, at least one of the cross members 112 of the frame member 111 is composed of two layers, between which there are provided wiring conductors 114 for the column-selecting grids 6. In addition, the cross member 112 is provided with external terminals 115 for the grids 6 and also external terminals 117 for the grids 7. The side members 113 of the frame member 111 are provided with holders 118 for the filament or filaments 8. With the above construction, the aforementioned assembly can be made in such a very simplified process as will be hereinafter described in detail.

The wiring conductors 114 for the column-selecting grids 6, the number of which corresponds to that of columns per pattern display section 2 (5 columns, in the case of the example shown in FIG. 8), are provided on the base portion 112*a* of the cross member 112. The wiring conductors 114 are connected, at the ends thereof, to the external terminals for the column-selecting grids 6, respectively. Then, the coating portion 112*b* of the cross member 112, which is provided at its predetermined positions with through-holes communicating with the wiring conductors 114 respectively, is laminated on the cross-member base portion 112*a* on which the wiring conductors 114 have been formed. Thus, the cross-member base portion 112*a* is combined with the cross-member coating portion 112*b* to form the cross member 112. The through-holes 116 are filled with conductive material. In addition, metal paste suitable as solder, such as nickel, is printed and baked at the predetermined positions on the cross members 112 to form junctions 112*c* thereon. When the junctions 112*c* are formed on the cross-member coating portion 112*b*, they may be located at the positions corresponding to the through-holes 116. In this case, the junctions 112*c* are formed from the aforementioned conductive material.

Each of the column-selecting grids 6 is provided, at its both ends, with extensions serving as supporting sections 6*b*. In order to facilitate the production of the column-selecting grids 6 and the mounting thereof on the frame member 111, the column-selecting grids 6 are originally connected together, each at least at one of its supporting sections 6*b*, by a common connecting section 6*a* made of metallic material. The supporting sections 6*b* thus connected are placed on the aforementioned junctions 112*c*, being heated for brazing. Thus, the column-selecting grids 6 are fixedly mounted on the cross members 112 of the frame member 111. In this state, the supporting sections 6*b*, of the column-selecting grids 6 are connected to the conductive material filled in the respective through-holes 116 of the cross-member coating portion 112*b*, and thereby every group of the corresponding column-selecting grids 6 for the respective pattern display sections 2 is electrically connected together, being coupled with one of the external terminals 115 through one of the wiring conductors 114. After the grids 6 are mounted, the connecting section 6*a* is removed along the dot-dash line X—X in FIG. 8, for instance.

The position-selecting grids 7, similar to the column-selecting grids 6, may be mounted as follows:

Junctions are formed on the mounting surface of the cross members 112 of the frame member 111 by printing and baking metal paste suitable as solder thereon. The supporting sections of metallic material of the position-selecting grids 7 are placed on the aforementioned junctions, being fixedly mounted thereon by brazing. Thus, the position-selecting grids 7 are attached to the frame member 111. In this case, each of the position-selecting grids 7 is previously provided with an external terminal 117 formed integrally with one of its supporting sections.

In addition, filament holders 118 for supporting the filament or filaments 8 are attached to the longitudinal ends of the frame member 111, respectively.

Thus, the structure shown in FIG. 8 can be assembled by the use of the frame member 111 so that the correct positional relationships are established among the column-selecting grids 6, the wiring conductors 114 and external terminals 115 thereof, the position-selecting grids 7 and the external terminals thereof, and the filament holders 118 for holding the filament or filaments 8. In addition, the assemblying operation of the structure can be performed separately from the operation for mounting the anodes 3 on the substrate 1. As a result, the assemblying operation can be much simplified and, in addition, can be performed with highly improved efficiency and with sufficiently high accuracy.

In the above-mentioned third embodiment of the present invention, description was made on an example of the single-row-display type fluorescent display device in which the pattern display sections 2 are arranged on a single sheet of the substrate 1 in a single line in the direction of the row.

Figure 9:
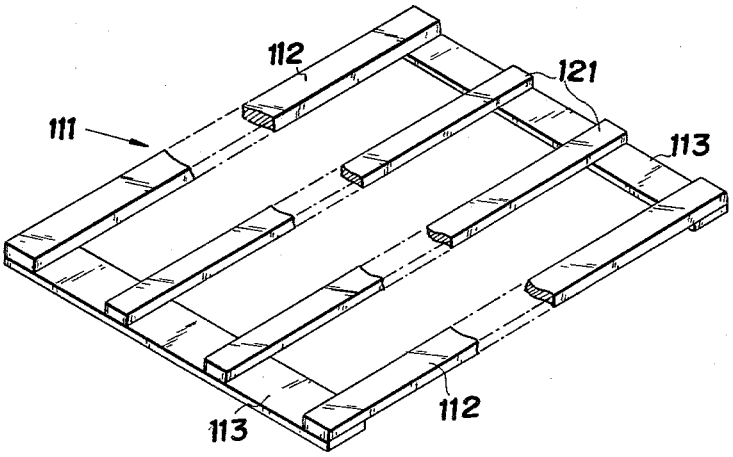
FIG. 9 is a schematical perspective view of a frame member for use in the fluorescent display device according to the fourth preferred embodiment of the present invention.

Meanwhile, in the so-called multi-row-display type fluorescent display device in which the pattern display sections 2 are arranged in a plurality of lines, the frame member 111 may be provided, as necessary, with reinforcing members 121 positioned opposite to the spaces between the rows of the pattern display sections 2 as shown in FIG. 9 associated with the fourth preferred embodiment of the present invention. Besides, in a large-sized display device, the frame member 111 may be reinforced by providing the reinforcing members made of the same metallic material as the side members 113 and positioned opposite to the spaces between the pattern display sections 2, as necessary, even when the pattern display sections 2 are arranged in a single row.

In order to reinforce the assembly consisting of the frame member 111, the column-selecting grids 6 and the position-selecting grids 7, the reinforcing members may be attached to the frame member 111 on which the column-selecting members 6 or the position-selecting members 7 have been mounted. If, in this case, these reinforcing members are attached to the side of the frame member 111 where the column-selecting grids 6 have been mounted, they can serve as spacer members for controlling the distance from the pattern display sections 2 to the column-selecting grids 6. Thus, the operation for disposing the above-mentioned assembly above the pattern display sections 2 can be further simplified.

In the above-mentioned preferred embodiments, description was made on the examples in which the wiring conductors 114, for electrically connecting the column-selecting grids 6 facing the corresponding anode columns of the respective pattern display sections 2, are provided between the base portion 112*a* and coating portion 112*b* of the cross member 112. According to the present invention, the wiring conductors electrically connected to the respective position-selecting grids 7 may be provided between the base portion 112*a* and coating portion 112*b* of the cross member 112. With the arrangement mentioned above, the external terminals of the column-selecting grids 6 and position-selecting grids 7 can be arranged collectively at a suitable portion of the cross member 112. Thus, the connections of the external terminals can be simplified and rationalized.

The above-mentioned various wiring conductors may be connected to the external terminals through the wiring conductors provided on the substrate 1, as a matter of course.

In each of the above-mentioned preferred embodiments, description was made on the example in which the anodes arranged in the pattern display sections in the form of a matrix are connected by wiring conductors on a column-by-column basis and the column-selecting grids are provided on a row-by-row basis. However, according to the present invention, the anodes may be connected by wiring conductors on a row-by-row basis, and row-selecting grids may be provided on a column-by-column basis.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. In a fluorescent display device having a plurality of pattern display sections each composed of a plurality of phosphor-coated anodes arranged in the form of a matrix, and at least a filamentary cathode for emitting electrons when heated, said anodes being selectively bombarded with electrons emitted from said filamentary cathode thereby to produce a visual display of characters, graphic forms and the like, the improvement which comprises: position-selecting grids provided between said filamentary cathode and said pattern display section, one for each of said pattern display sections; column-selecting grids or row-selecting grids provided above, along and opposite to the columns or rows of said anodes of said pattern display sections, one for each of the columns or rows of said anodes; and a frame member provided on its surface facing said filamentary cathode with said position-selecting grids and on its surface facing said pattern display sections with said column-selecting grids or said row-selecting grids, and at least the portions of said frame member where said grids are mounted being made of insulating material; said frame member being composed of a plurality of cross members of insulating material on which said grids are mounted, and a plurality of side members made of material having almost the same thermal expansion properties as said grids.

2. The fluorescent display device as set forth in claim 1 wherein said frame member has reinforcing members positioned along and opposite to the spaces between said pattern display sections.

3. The fluorescent display device as set forth in claim 1 wherein said frame member is provided with filament-holders for supporting said filamentary cathode.

4. The fluorescent display device as set forth in claim 1 wherein the portions of said frame member which are made of insulating material are composed of two layers between which wiring conductors are provided which electrically connect said column-selecting grids or said row-selecting grids facing the corresponding columns or rows of the anodes of said pattern display sections.

5. The fluorescent display device as set forth in claim 4, wherein said wiring conductors are provided at the ends thereof with external terminals for giving drive signals to said column-selecting grids or said row-selecting grids.

6. The fluorescent display device as set forth in claim 1 wherein said position-selecting grids are formed integrally with external terminals for giving a drive signal to said position-selecting grids, respectively.

7. In a fluorescent display device having a plurality of pattern display sections each composed of a plurality of phosphor-coated anodes arranged in the form of a matrix, and at least a filamentary cathode for emitting electrons when heated, said anodes being selectively bombarded with electrons emitted from said filamentary cathode thereby to produce a visual display of characters, graphic forms and the like, the improvement which comprises: position-selecting grids provided between said filamentary cathode and said pattern display section, one for each of said pattern display sections; column-selecting grids or row-selecting grids provided above, along and opposite to the columns or rows of said anodes of said pattern display sections, one for each of the columns or rows of said anodes; and a frame member provided on its surface facing said filamentary cathode with said position-selecting grids and on its surface facing said pattern display sections with said column-selecting grids or said row-selecting grids, and at least the portions of said frame member where said grids are mounted being made of two layers of insulating material between which wiring conductors are provided which electrically connect said column-selecting grids or said row-selecting grids facing the corresponding columns or rows of the anodes of said pattern display sections.

* * * * *